United States Patent [19]

Fischer

[11] 4,243,874

[45] Jan. 6, 1981

[54] RADIANT HEATING UNIT

[76] Inventor: Karl Fischer, Am Gaensberg 8, 7519 Oberderdingen, Fed. Rep. of Germany

[21] Appl. No.: 918,300

[22] Filed: Jun. 22, 1978

[30] Foreign Application Priority Data

Jul. 2, 1977 [DE] Fed. Rep. of Germany ..... 2729929
May 9, 1978 [DE] Fed. Rep. of Germany ..... 2820138

[51] Int. Cl.[3] ..... H05B 3/74; H05B 3/76

[52] U.S. Cl. ..... 219/467; 219/354; 219/355; 219/449; 219/457; 219/460; 219/462

[58] Field of Search ..... 219/464, 448–452, 219/532, 542, 355, 443, 455, 457–463, 465, 467; 338/58 256, 258, 287, 290, 292, 293, 298–301, 304–306, 307, 308, 318

[56] References Cited

U.S. PATENT DOCUMENTS

| | | | |
|---|---|---|---|
| 1,195,828 | 8/1916 | McClatchie | 338/285 |
| 1,276,096 | 8/1918 | Moffat | 338/285 |
| 1,555,543 | 9/1925 | Ziola | 219/451 |
| 1,673,225 | 6/1928 | Bange | 219/451 |
| 2,231,236 | 2/1941 | Wentworth | 219/464 |
| 2,261,533 | 11/1941 | Vineberg | 219/467 |
| 2,913,695 | 11/1959 | Borghult et al. | 338/283 |

FOREIGN PATENT DOCUMENTS 2165569 5/1973 Fed. Rep. of Germany .

*Primary Examiner*—Thomas J. Kozma
*Assistant Examiner*—Bernard Roskoski
*Attorney, Agent, or Firm*—Steele, Gould & Fried

[57] ABSTRACT

A radiant heating unit is provided with heating resistances which are arranged on an insulating support which is substantially plate-shaped in the heating region. The insulating support has elevations formed thereon into which the heating resistances are partially embedded. For the rest, the heating resistances run substantially unembedded on the surface of the insulating support.

36 Claims, 12 Drawing Figures

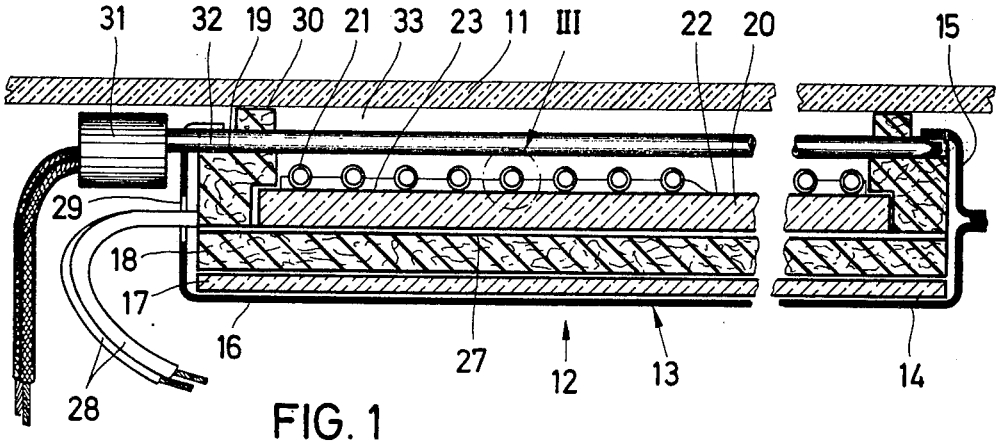
FIG. 1
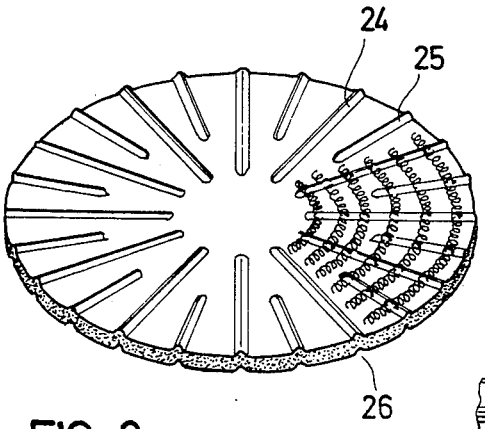
FIG. 2
FIG. 3
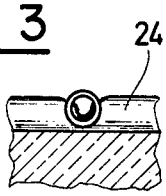
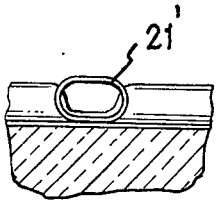
FIG. 3a
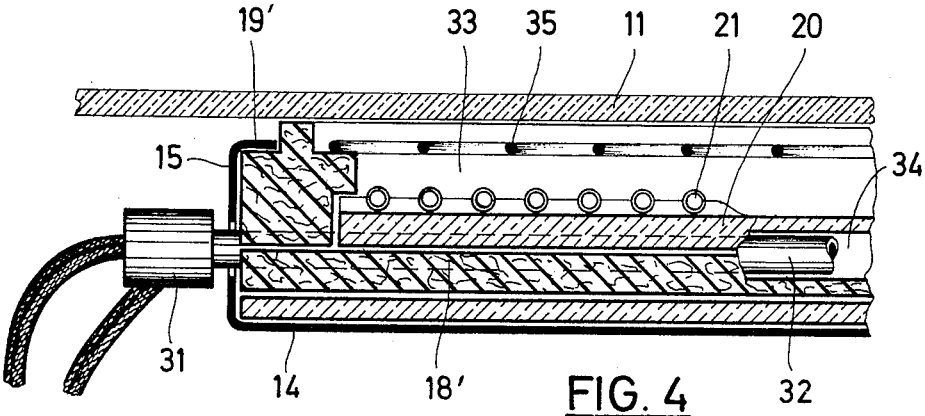
FIG. 4

FIG.5
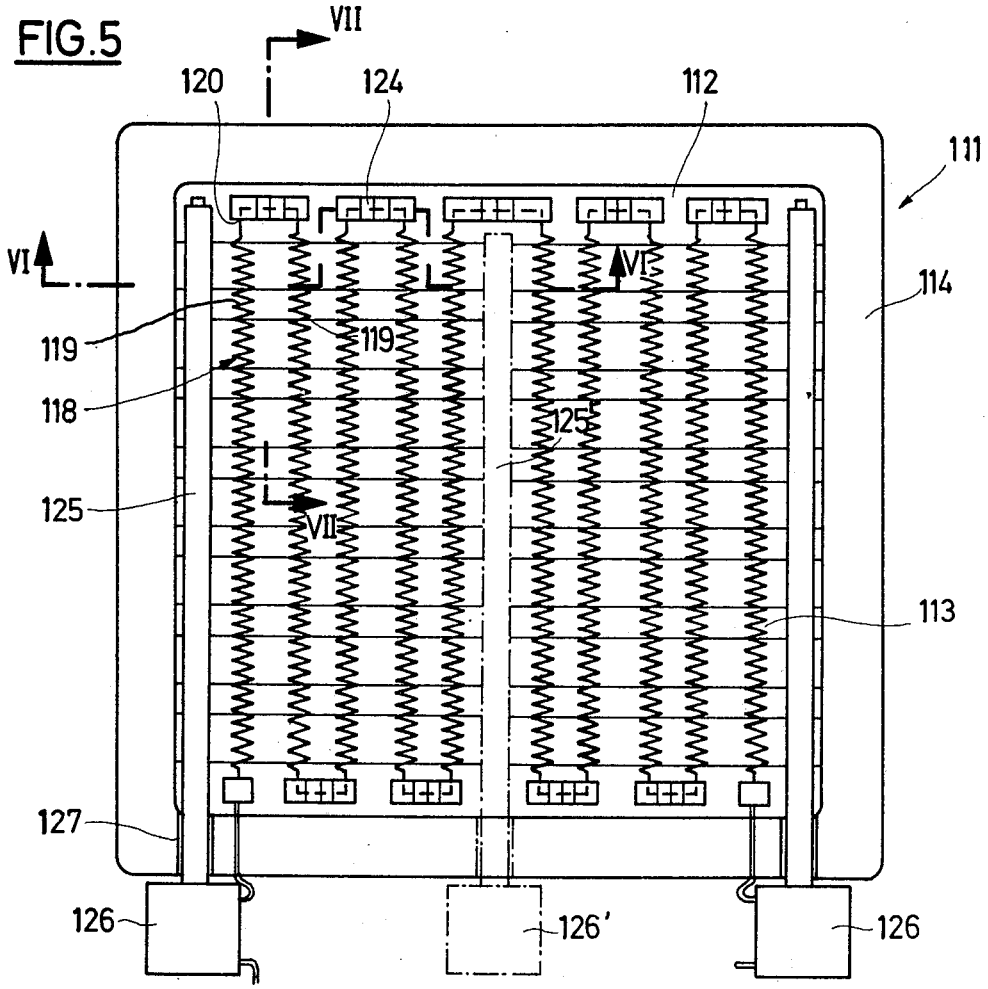
FIG.6
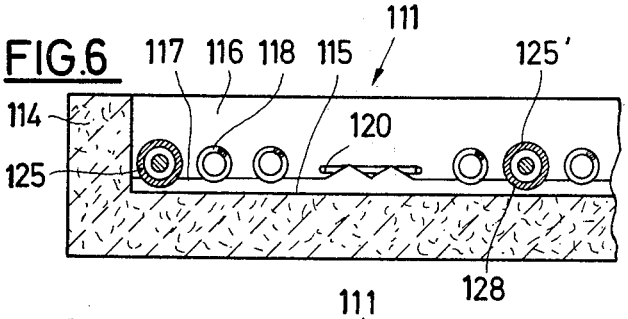
FIG.9
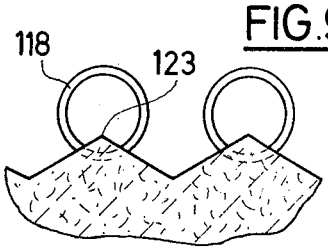
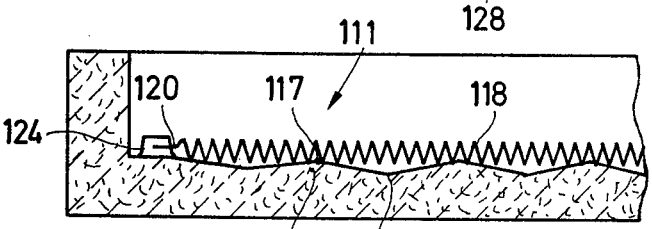
FIG.7
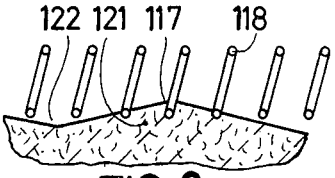
FIG.8

RADIANT HEATING UNIT

FIELD OF THE INVENTION

The invention relates to a radiant heating unit, in particular for glass ceramic electric cooker appliances with heating resistances arranged on an insulating support which is substantially plate-shaped in the heating region.

BACKGROUND OF THE INVENTION

A heating unit of this type is known from U.S. Pat. Nos. 3,612,828 and 3,624,352, in which a large block of insulating material lies in a support tray and an insulating support which is also large with a raised edge and a raised central zone lies on this block of insulating material. An annular region is milled out to form a relatively flat radiation chamber. Heating resistances in the form of meanderingly curved heating strips are inserted in grooves on its base. This heating unit has the disadvantage of having a substantial height and can therefore be used only in cooking stoves and not in flat fitted troughs. The thickness of the insulating material results particularly from the fact that the insulating support must consist of a material with high mechanical strength which consequently has a lower insulating capacity and is a greater conductor of heat. In addition, this insulating support is heated relatively greatly by the heating resistances and the upward radiation face is small. An electric cooker appliance with a glass ceramic plate is known from German Offenlegungschrift No. 21 65 569, the heating unit of which has radially running insulating webs on a sheet metal support, which insulating webs guide the heating coil relatively closely beneath the glass ceramic plate. The sheet metal support is located in a support tray and is lined with insulating material. This design requires the use of numerous insulating webs on the support plate composed of metal. The distance from the glass ceramic plate is small and special steps have to be taken to satisfy the requirements of resistance to impact and protection from contact in the case of possible breakage of the glass ceramic plate. The heating unit has to be completed before insertion of the heating coils and can only be exchanged in its entirety. Moreover, it is laborious to insert the spirals into the insulating webs. The heating coils tend to sag and may need intermediate supports, particularly if the thickness of the wire has to be small owing to the use of a high operating voltage.

SUMMARY OF THE INVENTION

An object of the invention is to provide a radiant heating unit which is simple to produce and has good coefficients of radiation and good positional security of the heating resistances under all operating conditions.

According to the invention there is provided a radiant heating unit with heating resistances which are arranged on an insulating support which is substantially plate-shaped in the heating region, wherein the insulating support has elevations shaped from it into which elevations the heating resistances are partially embedded, the heating resistances additionally running substantially unembedded on the surface of the insulating support.

The heating resistances which thus either lie on the surface of the insulating support or can run slightly above its surface are thus fixed in the region of the elevations in the insulating body itself. The heating resistances are preferably wire coils which are embedded about halfway up the elevations. However, the centre of the wire coils advantageously remains substantially free from embedding. The material of which the insulating support is composed penetrates only poorly between the individual windings of the coils and surrounds substantially only the wires and secures them without however completely filling the core of the coil.

It should be noted that a heating unit can be created in this way which has the good coefficients of radiation as well as good fixing of the heating coils on the insulating support.

The elevations are preferably ribs which run transversely to the length of the heating resistances and the heating resistances are particularly preferably arranged spirally with the elevations running substantially radially to them on the insulating support. However, the elevations could alternatively be individual stud-shaped projections.

The insulating support which can be pressed from an insulating material containing fibrous materials can be joined to the heating resistance during the pressing process. Thereafter, a drying or firing process is normally carried out.

The insulating support can be, for example a dish-shaped insulating component on whose internal base the heating resistances are arranged. A particularly preferred design, however, is one in which the insulating support has the shape of a separate substantially flat plate which is lined as well as laterally surrounded and centred by an insulator.

In a preferred embodiment, the insulating support can have the shape of a separate substantially flat plate which is also laterally surrounded and centred by the insulator. The insulating support can therefore consist of a material which is somewhat stronger mechanically and therefore not such a good insulator, but which is an easily manageable unit which may be inserted in a highly effective insulator in such a way that the entire heating unit can be constructed very flat with optimum insulation.

In one preferred feature of the invention, the surface of the insulating support is of zig-zag design and flat in cross-section, wherein the apices running substantially transversely to the length of the heating resistance form the elevations into which the heating resistances are partially embedded. Using this arrangement, it is possible to ensure that the heating resistances are embedded only in a small region but are still fixed sufficiently securely on the insulating support. The zig-zag design also affords the opportunity of lowering the heating resistances somewhat during heating and the associated expansion so that the heating resistances are not able to bend out laterally. The apices are preferably pointed, only one or very few windings of the heating resistance being embedded. This counteracts particularly effectively the accumulation of heat in the embedded region. Corrugations running transversely to the first direction of currugation may be arranged in addition to the zig-zag corrugated design of the surface of the insulating support in order to make the embedded region even smaller, so that the apices are lowered between the individual heating resistances. A point is then formed in the region of the heating resistances, into which point one or a few windings of the heating resistances are pressed. A rod-shaped temperature sensor running through beneath the heating resistances and crossing them is preferably arranged in an indentation lying between two apices. The heating resistances may be provided with a quartz glass covering which is sufficiently temperature-resistant for protection from short-circuiting as a result of contact with the heating resistances.

BRIEF DESCRIPTION OF THE DRAWINGS

FIG. 1 is a partially cut-away central section through a radiant heating unit of a glass ceramic cooker appliance;

FIG. 2 is a perspective view of the insulating support used therein;

FIG. 3 shows an enlarged detail corresponding to the dash-dotted circle III in FIG. 1;

FIG. 3*a* shows an alternative embodiment to the enlarged detail of FIG. 3;

FIG. 4 shows a variation in the construction of FIG. 1;

FIG. 5 is a plan view of a heating unit, an alternative design being indicated in dash-dotted lines;

FIG. 6 is a section along the line VI—VI in FIG. 5;

FIG. 7 is a section along the line VII—VII in FIG. 5;

FIG. 8 is an enlarged section corresponding to the section of FIG. 7;

FIG. 9 is an enlarged section of a variation in the section according to FIG. 6;

DESCRIPTION OF PREFERRED EMBODIMENTS

Figure 10:
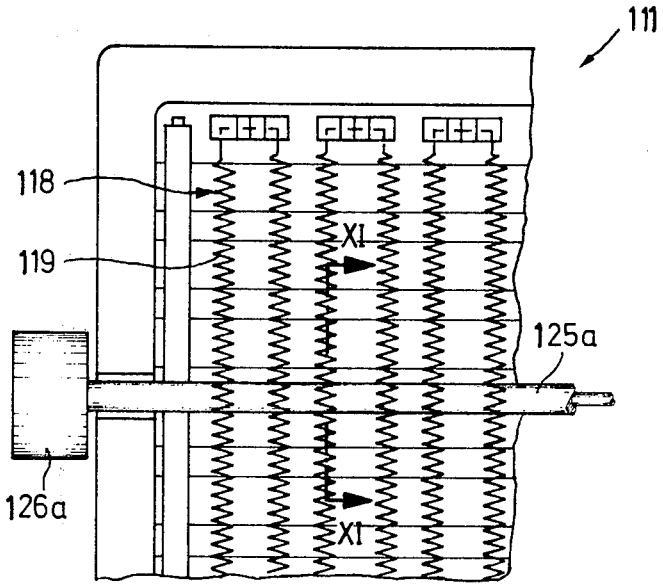
FIG. 10 is a plan view of another embodiment.

FIG. 1 shows a glass ceramic plate 11 which forms the cooking surface of an electric cooker appliance only part of which is shown. A heating unit 12 is arranged below the glass ceramic plate, and is preferably urged by means of spring elements not shown on to the underside of the glass ceramic plate. The heating unit 12 has a support tray 13 made of sheet metal which consists of a lower sheet metal component 14 in the form of a flat dish with a flat base and an upper sheet metal component 15 in the form of a ring with a Z-shaped cross-section. The two sheet metal components are joined together on their superimposed ring flanges.

The support tray 13 is lined with an insulator comprising two insulating layers or discs 17 and 18 running parallel to the base 16 of the support tray and an insulating ring 19. These insulating layers can be formed of many different materials. Since the properties of heat insulation is highly heat-resistant insulators, which are to be used, decreases as the mechanical strength increases, a material of relatively low mechanical strength but high heat insulating capacity can be used for the insulating layers 17, 18 since these layers are subject to very lower mechanical loads. The bottom layer 17 can also consist, for example of a non-compacted or only very slightly compacted bulk material (for example finely divided silica) or, since this is the "coldest" point of the heating unit, of a material of lesser heat resistance. On the other hand, the insulating ring 19, which has a certain supporting function, should be designed mechanically to take somewhat higher loads. It can be made of a fibrous insulating material, for example of an aluminium oxide fibres which, when compressed with addition of suitable binders, acquire a cardboard-like structure. A similar material is commercially available under the name "Fiberfrax". However, other mineral fibres may also be used as a basis for the insulator.

An insulating support 20 which has the shape of a circular disc, lies on the upper insulating layer 18 and inside the insulating ring 19, with the edge of the support 20 being enclosed in an annular recess of the insulating ring. The dimensions of a conventional heating body for a glass ceramic stove are in the order of magnitude of 15 cm in diameter and 5 mm thick. This insulating support also consists of a pressed fibrous insulating material with very high heat resistance and has on its upper side spirally running heating resistances 21 consisting of wire coils, an annular heating region thus being created which leaves free only an unheated central zone 22.

The majority of the length of the heating resistances 21 lies on the surface 23 of the insulating support 20 or slightly beyond it. Elevations 24 and 25 which run radially project from the substantially flat surface 23. The elevations 24 run from the outer edge through to the unheated central zone, while the elevations 25 end about half-way to that zone. This ensures that the distances between adjacent elevations remain within a predetermined range. These elevations are produced by stamping the insulating support during its production by pressing the fibrous composition provided with binders. The heating resistances are thus pressed in so that they penetrate the elevations and are held in them. As shown in FIG. 3, the heating resistances in the region of the elevations are preferably embedded up to a level somewhat more than half-way up the cross-section of the coil, with the upper portion of the windings and indeed almost the entire upper half as well as the interior of the coil remaining free.

Although the heating resistances are secured extremely well in this way, their heat radiation is hardly affected. The heating resistances can radiate unobstructed in the entire region between the elevations and even radiation from the lower region of the winding is obstructed only in the region of the elevations. A very effective heating element is thus provided which ensures high coefficients of radiation upwards.

The insulating support 20 should have higher mechanical strength than the remaining insulation, and this may be achieved, for example by suitable selection of material or greater compression of the material. The support 20 is in the form of a disc which does indeed still have a certain cardboard-like structure but which may be easily handled during production, assembly and repair. The heating resistances are so secure on this disc that there is no risk of them becoming loose owing to vibration or thermal expansion.

The stampings forming the elevations 24 and 25 produce indentations 26 on the underside of the insulating support. Recesses 27 are preferably also provided on the upper side of the upper insulating layer 18 so that these recesses which can create an air space which also contributes to the insulation. The electric connection of the spirals leads downwards, preferably through the insulating support, so that the connecting wires can run, for example, in one of the recesses 26. The corresponding connecting pins or tongues can be pressed through the still soft material of the insulating support during the compression process. The insulating support is normally exposed to another drying or firing process after compression.

The heating unit is assembled by firstly pouring and/or if previously pressed discs are used, inserting the insulating layers 17 and 18 into the lower sheet metal component 14, and by laying the insulating support 20 on it. The connecting wires 28 are guided out laterally through a recess 29 in the region of the separating line between the sheet metal components 14 and 15. The insulating ring 19 is subsequently put in place and the heating unit is completed by placing and fixing the upper sheet metal component 15. The insulating ring 19 also has an upwardly projecting ring region 30 which is joined to the underside of the glass ceramic plate.

FIG. 1 also shows a temperature limiter or temperature regulator 31 arranged in such a way that a rod-shaped temperature sensor 32 thereof penetrates along a diameter through the radiation chamber 33 formed between the heating resistances 21 and the underside of the glass ceramic plate 11. The temperature sensor runs through an opening in the sheet metal component 15 and the insulating ring 19. In this embodiment, however, the the temperature sensor has to be electrically insulated, for example, covered with a quartz tube, in order to protect it from contact in the event of a possible breakage of the glass ceramic plate.

For this reason, in the embodiment shown in FIG. 4 which is otherwise similar, the temperature regulator 31 is arranged in such a way that is also penetrates in the separating line of the two sheet metal components 14 and 15 and lies in a recess on the underside of the insulating ring 19' and on the upper side of the insulating layer 18'. The insulating support 20 also has a diametral recess 34 for the temperature sensor 32, so that the temperature sensor can easily detect the heating temperature, since the insulating support very rapidly assumes the temperature of the heating means owing to its higher mechanical strength and therefore somewhat lower thermal insulation.

The radiation chamber 33 therefore remains substantially free and an earth grid 35 can be inserted, the earth grid lying on a shoulder of the insulating ring 19' and forming a contact protection against the live heating resistances 21 just below the glass ceramic plate.

Since the entire insulation afforded by the components 17, 18 and 19 and also the insulating support 20 is to be compacted only as much as is absolutely essential for mechanical strength, the surface of the insulating components may wear somewhat as a result of mechanical contact. For this reason, it may be desirable to treat the surfaces of the insulating components specially, for example to provide them with a larger addition of binder or to spray them with a heat-resistant lacquer. It is also very advantageous to provide the upper side of the insulating support with a lacquer which provides, as nearly as possible, black body heat radiation, so as to improve the upward radiation of heat.

The heating units normally have a circular form and it is then also desirable to make the insulating support circular. However, it can be advantageous to use rectangular or square heating units in order to make better use of the normal four-way arrangement. In this case, the insulating ring for bridging over should have an externally rectangular and internally circular shape when using a circular insulating support.

In the case of a rectangular insulating support or insulating ring with a circular heating ring region, it is possible to arrange monitoring or sensing instruments for monitoring the temperature in the unheated corners thereby formed. The particularly advantageous possibility of using a pourable insulating material in the region of the insulating layers 17 and 18 which has the advantage of a very high heat-insulating capacity, is made possible by arranging the heating element on a mechanically quite strong insulating support which forms a dense termination. With varying mains voltage or heating powers, only one other insulating support with heating resistances has to be produced, the other heating unit staying the same and being producible on a large scale. This is also important as regards the stocking of supplies and spare parts. The spiral arrangement of the heating resistances can be bifilar, that is to say the two ends of the heating resistance lie on the periphery and the spiral heating resistance runs to the centre with two strands parallel to each other in each case. The fact that the wires leave radially enables the insulating support to be connected particularly well to be stacked easily, thereby simplifying transportation.

The heating resistances on the insulating support are normally spirally laid circular wire coils. It can however also be advantageous to make the wire 21 oval, with their smallest dimension toward the ceramic glass plate, as shown in FIG. 3*a*.

The radiation chamber can therefore receive, even with quite large coils, a sufficient magnitude which, under certain circumstances, is also necessary to provide the required impact resistance. It is nevertheless always particularly difficult, in spite of good insulation and the impact resistance required, to produce heating units of very small thickness which at the same time have a sufficiently low temperature on their underside to be adjacent to burnable kitchen utensils.

In another modification (not shown), the spirals are laid somewhat lower at individual points on the insulating support (or even the entire insulating support), for example so as to create space for a temperature sensor rod. The insulating distance required can be obtained by means of this indentation without having to place the entire radiation face lower.

In the embodiments described above, each heating unit has a separate support tray which is pressed on to the glass ceramic plate. It is however, also advantageously possible to use for a multiple unit cooker appliance, a single support tray, in which lies an insulator defining several dish-like recesses for receiving the insulating support.

The heating unit 111 shown in FIGS. 5 to 9 has an insulating support 112 in the form of a flat tray which is rectangular and preferably square in plan view and has a base 113 and edges 114. The support 112 is produced from insulating material, for example a fibrous insulating material deformed by pressing and solidified to the required degree by binders.

The surface 115 of the base 113 facing the interior of the tray 116 is of zig-zag shape, as shown in particular in FIGS. 7 and 8. It therefore consists of corrugated elevations and indentations running in parallel, the apices 117 of which, however, are relatively sharp. The zig-zag shape is relatively flat.

A heating resistance 118 is arranged in the interior 116 and on the surface 115 and consists of a spiral resistance wire has a plurality of successive sections 119 resistance running to and fro close to each other. The sections are joined together by U-shaped regions 120 which are designed substantially as smooth and uncoiled wire, for example by placing the heated coil under tension. These connecting regions are embedded in elevations 124 of the insulating support, being preferably pressed in before the insulating support hardens. The elevations can have the shape of one or more zig-zag corrugations so that the embedded region is kept to a minimum but provide sufficient fixing.

It should be noted that the length of the zig-zag shaped elevations 121 and the indentations 122 lying between them runs transversely to the length of the heating resistance sections 119. FIG. 8 shows that only one or a few turns of the heating resistances are embedded in the region of each apex 117, by pressing in prior to hardening. Thus, only a small area which faces the surface 115 of each winding is embedded while the remaining area of the periphery of the winding remains free.

FIG. 9 shows a modification in which another corrugation is made transversely to the elevations 121' and indentations 122', so that the heating coils are embedded on a point 123 formed by the points of intersection of the elevations.

It should be noted that, by this means, the heating coils, although adequately secured on the insulating support which thus forms a unit which can be mounted and handled easily, are embedded only in very small regions so that there is no danger of local over-heating at these points, which could lead to burning through. This is aided by the fact that the spirals when expanded can be adapted to the somewhat zig-zag-shaped surface and thus lie on the surface without having to bend out laterally as a result of accumulation. Above all, however, the entire upper side of the heating coils is free and can radiate freely. It is possible to cover a very high percentage of the heating surface owing to the meandering path of the heating resistance. This is assisted by the fact that the heating coils can lie relatively closely next to each other because the zig-zag-shaped design and the prevention of lateral deviation reduces the risk of short-circuits and because possible short-circuits do not have serious consequences since the voltage differences between the individual sections 119 are small.

Only a small amount of heat energy is liberated in the connecting regions 120 because uncoiled wire is used there. This is particularly important because the risk of accumulations of heat arises as a result of the U-bends and would be further aggravated by the fixation by embedding needed there.

Temperature sensors 125 of temperature switching members 126, which can be either temperature limiters or temperature regulators, run on both sides of the external heating resistance sections 119. These may be rod-shaped temperature sensors each of which is in the form of an expansion tube and a rod lying therein and adapted to expand relatively slightly. The sensors extend over the entire internal edge length of the insulating support and run along between the edge 114 and the external section 119 in the plane of the heating resistances. They penetrate through a recess 127 in the edge 114, so that their head supporting the switch lies outside the heated region. The connection of the heating resistance 118 is also guided through in this region and can be connected directly to the connection of the head of the switch so that the head of the switch also forms the connecting component for the heating resistance. With an arrangement of temperature sensors on both sides, both connections are thus made by means of the temperature switching members so that special connecting components are not needed. The temperature switching members are thus connected in series with the heating resistance so that the response of a temperature sensor disconnects the heating resistance 118.

As a modification, FIGS. 5 and 6 show a temperature switching member 26' which can be identical to those already described. Its temperature sensor 125' lies somewhat below the plane of the heating resistances in an indentation 128 of the insulating support which breaks through the ribs 121. However, the temperature sensor is also parallel to the section 119 and is provided in the immediate vicinity of two sections so that it can effectively sense the temperature of the heating resistances. The described temperature sensor arrangement parallel to the heating resistances ensures effective regulation and temperature restriction, which prevent excess temperatures in the glass ceramic plate. Peaks of temperature caused by increases in the temperature of the heating resistances and thus in the glass ceramic material and which could lead to damage of the glass ceramic surface are prevented in this way. Heating can thus be effected at a higher average value and this in turn increases the throughput of power.

Figure 11:
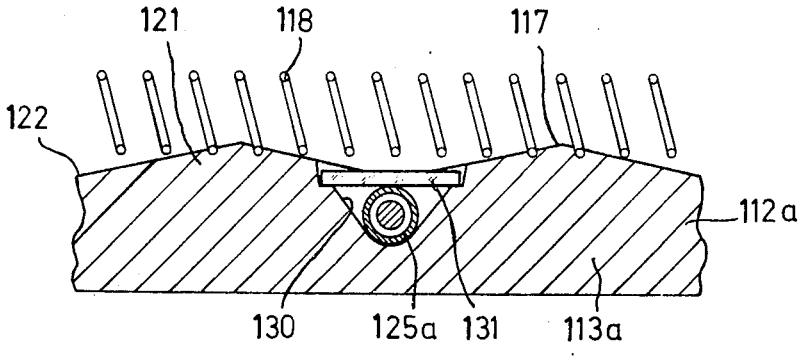
FIG. 11 is an enlarged detailed section along the line XI—XI in FIG. 10.

The heating unit 111' shown in FIG. 10 corresponds to the embodiment according to FIG. 5 with respect to the design of the insulating support and the design and arrangement of the heating resistances. The only difference is in the temperature switching member **126*a* which is provided. The associated temperature sensor 125*a*, also a rod sensor, lies in a deep recess 130 in the base 113*a* of the insulating support 112*a*, as shown in FIG. 11. The recess and therefore the temperature sensor 125*a* runs transversely to the arrangement of the individual sections 119 of the heating resistance 118. As the sensor 125*a* runs relatively closely beneath the heating resistances, the resistance 130 is provided with a covering 131** in the form of a quartz glass disc. It would also be possible in this embodiment to provide the sensor with a coating made of a material which is resistant to high temperatures and which is insulating but permeable to heat radiation.

Numerous modifications of the embodiments illustrated and described are possible. Thus, for example, a zig-zag-shaped design could be used in which a flatter part is interpolated in the region of the indentations 122. Particular care should be taken when fixing the heating resistances to ensure that the apices 17 are relatively pointed so that the embedded region of the heating coils is relatively small. Instead of heating a glass ceramic cooker plate as described, the heating unit can also be used for heating other articles, for example in industrial furnaces for heating metal plates or walls or for heating vessels.

I claim:

1. A radiant heating unit comprising an insulating support which is substantially plate-shaped in a heating region and heating resistances arranged on the insulating support, the insulating support having elevations shaped from it and the heating resistances being partially embedded within the insulating support, only at the elevations, and unembedded elsewhere on the surface of the insulating support, the elevations being spaced from one another in the longitudinal direction of the heating resistances.

2. A heating unit according to claim 1, wherein the heating resistances are wire coils and the region of the central axis of the wire coils is unembedded.

3. A heating unit according to claim 1, wherein the elevations are ribs which run transversely to the length of the heating resistances.

4. A heating unit according to claim 1 wherein the insulating support is pressed from an insulating material containing fibrous material.

5. A heating unit according to claim 4, wherein the heating resistances are partially pressed into the insulating support during the pressing process.

6. A heating unit according to claim 1, wherein the heating resistances are arranged spirally and the elevations run substantially radially to them on the insulating support.

7. A heating unit according to claim 1, wherein the elevations are stampings which have corresponding recesses on the underside of the insulating support.

8. A heating unit according to claim 1, wherein the insulating support comprises a support tray and a separate, substantially flat plate which lies in the support tray and is lined as well as laterally surrounded and centered by an insulator.

9. A heating element according to claim 8, wherein the insulator has the general shape of a dish lying in the support tray, the base of the dish supporting the insulating body.

10. A heating unit accoring to claim 8, wherein in that the insulator consists of one or more insulating layers covering the base of the support tray and an insulating ring surrounding the perimeter of the insulating support.

11. A heating unit according to claim 10, wherein the insulating ring overlaps the edge of the insulating support.

12. A heating unit according to claim 10, wherein the insulating support is of a mechanically stronger material than the said insulator.

13. A heating unit according to claim 10, wherein the support tray overlaps at least part of the edge of the insulating ring.

14. A heating unit according to claim 10, wherein electrically conductive wires for supplying current to the heating resistances are guided between the insulating ring and the insulating layers to the heating resistances.

15. A heating unit according to claim 10, wherein the insulating ring supports an earth grid.

16. A heating unit according to claim 10 wherein the underside of the insulating support co-operates with the upper side of the insulating layer adjacent to the insulating support to form air spaces.

17. A heating unit according to claim 10, wherein at least one of the insulating layers if of a pourable insulating material.

18. A heating unit according to claim 1 wherein parts of the insulator and/or the insulating support are provided with a surface coating.

19. A heating unit according to claim 1, wherein the upward facing surface of the insulating support is provided with a readily radiating coating.

20. A heating unit according to claim 1, wherein the heating resistances are formed by wire coils having an oval cross-section with the smaller cross-sectional dimension being perpendicular to the insulating support.

21. A heating unit according to claim 1, wherein the insulation has a plurality of identations in each of which lies an insulating support.

22. A heating unit according to claim 1, having a glass ceramic cooker plate on the upper side thereof.

23. A heating unit according to claim 1, wherein the surface of the insulating support is of zig-zag design which is flat in cross-section, the apices of the zig-zag running substantially transversely to the length of the heating resistances and forming the elevations in which the heating resistances are partially embedded.

24. A heating unit according to claim 23, wherein the apices are pointed and embed at most only a few windings of the heating resistances.

25. A heating unit according to claim 23 wherein the apices are sunk between adjacent sections of the heating resistances so that a point is formed in the region of the heating resistances.

26. A heating unit according to claim 1, wherein a rod-shaped temperature sensor is arranged in an indentation of the insulating support.

27. A heating unit according to claim 1, wherein the heating resistance is formed of a plurality of sections which are parallel to one another, the sections being in the form of coils in the parallel sections and being connected to another by uncoiled wire.

28. A heatng unit according to claim 27, wherein the uncoiled wire is fixed in the connecting region by embedding in one of the elevations of the insulating support.

29. A heating unit according to claim 27, wherein the heating unit is rectangular.

30. A heating unit according to claim 27, wherein the heating unit is square.

31. A heating unit according to claim 27, wherein at least one rod-shaped temperature sensor is arranged parallel with the heating resistance sections.

32. A heating unit according to claim 31, wherein the temperature sensor is arranged substantially in the plane of the heating resistances.

33. A heating unit according to claim 31, wherein the temperature sensor runs between two heating resistance sections.

34. A heating unit according to claim 31, wherein the temperature sensor runs along at least one external heating resistance section.

35. A heating unit according to claim 34, wherein a temperature sensor runs along each external heating resistance section.

36. A heating unit according to claim 31, wherein the rod-shaped temperature sensor starts from a regulator head which is arranged outside the heated region at the beginning of the heating resistances and supports a wire connection for the heating resistance.

* * * * *